US010876345B2

(12) United States Patent
Banvait et al.

(10) Patent No.: US 10,876,345 B2
(45) **Date of Patent: *Dec. 29, 2020**

(54) INTELLIGENT VEHICLE ACCESS POINT OPENING SYSTEM

(71) Applicant: Ford Global Technologies, LLC, Dearborn, MI (US)

(72) Inventors: Harpreetsingh Banvait, Sunnyvale, CA (US); Jinesh J Jain, San Mateo, CA (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 167 days.

This patent is subject to a terminal disclaimer.

(21) Appl. No.: 16/045,379

(22) Filed: Jul. 25, 2018

(65) Prior Publication Data

US 2018/0328094 A1 Nov. 15, 2018

Related U.S. Application Data

(63) Continuation of application No. 14/923,038, filed on Oct. 26, 2015, now Pat. No. 10,113,351.

(51) Int. Cl.
*E05F 15/40* (2015.01)
*E05F 15/73* (2015.01)

(52) U.S. Cl.
CPC ..... *E05F 15/40* (2015.01); *E05F 15/73* (2015.01); *E05Y 2900/531* (2013.01)

(58) Field of Classification Search
CPC ..... B60R 21/01504
See application file for complete search history.

(56) References Cited

U.S. PATENT DOCUMENTS 4,422,521 A * 12/1983 Mochida ..... E05F 15/611 180/271
5,982,126 A 11/1999 Hellinga
6,840,113 B2 1/2005 Fukumura
7,698,855 B2 * 4/2010 Imai ..... E05F 15/659 49/360
7,797,881 B2 * 9/2010 Loitherstein ..... E05F 15/74 340/932.2
9,068,390 B2 * 6/2015 Ihlenburg ..... E05F 15/73
9,122,569 B2 * 9/2015 Ishibashi ..... B62D 15/0275
(Continued)

FOREIGN PATENT DOCUMENTS

EP 1422366 A2 * 5/2004 ..... E05F 15/40
EP 2317338 A2 * 5/2011 ..... G01S 15/931
(Continued)

*Primary Examiner* — Catherine A Kelly
(74) *Attorney, Agent, or Firm* — David R. Stevens; Stevens Law Group

(57) ABSTRACT

Methods and apparatus pertaining to an intelligent vehicle access point opening system are provided. A method may involve detecting a presence of an object in a vicinity of a cover of an access point of a vehicle. The method may also involve receiving a command to open the cover and activating a mechanism to open the cover responsive to receiving the command. The method may further involve determining whether the object is likely to fall as the cover is being opened. The method may additionally involve pausing opening of the cover responsive to a determination that the object is likely to fall as the cover is being opened.

20 Claims, 6 Drawing Sheets

(56) References Cited

U.S. PATENT DOCUMENTS

| | | | | |
|---|---|---|---|---|
| 9,135,822 | B2 * | 9/2015 | Lucking | B60Q 9/006 |
| 9,199,608 | B2 * | 12/2015 | Newman | B60R 25/2045 |
| 10,113,351 | B2 * | 10/2018 | Banvait | E05F 15/40 |
| 2002/0084675 | A1 * | 7/2002 | Buchanan, Jr. | B60J 5/101 296/146.8 |
| 2009/0000196 | A1 * | 1/2009 | Kollar | E05F 15/43 49/28 |
| 2009/0260289 | A1 * | 10/2009 | Carpenter | E05F 15/42 49/26 |
| 2011/0313619 | A1 * | 12/2011 | Washeleski | E05F 15/40 701/36 |
| 2015/0345205 | A1 * | 12/2015 | Gunreben | E05F 15/73 701/2 |
| 2016/0167519 | A1 * | 6/2016 | Luke | B60W 30/09 701/22 |
| 2016/0208537 | A1 * | 7/2016 | Senguttuvan | E05F 15/73 |
| 2017/0159347 | A1 * | 6/2017 | Mayr | B62D 33/027 |

FOREIGN PATENT DOCUMENTS

| | | | | |
|---|---|---|---|---|
| FR | 2971202 | A1 | 2/2011 | |
| JP | 2006159988 | A | 6/2006 | |
| WO | WO-2016026904 | A1 * | 2/2016 | B60P 1/4414 |

* cited by examiner

INTELLIGENT VEHICLE ACCESS POINT OPENING SYSTEM

CROSS REFERENCE TO RELATED PATENT APPLICATION

The present application is a continuation of U.S. patent application Ser. No. 14/923,038, filed on Oct. 26, 2015, which is incorporated by reference in its entirety.

TECHNICAL FIELD

The present disclosure generally relates to vehicles and, more particularly, to systems, methods, apparatuses for intelligent vehicle access point opening.

BACKGROUND

In today's vehicles, there are numerous types of mechanisms that automatically open the trunk or rear deck thereof. For example, by pressing a button or waving one's leg under the rear bumper, a user of the vehicle may be able to activate a mechanism to open the door, hatch or tailgate (commonly referred to as the "cover" of an access point of the vehicle herein) of the vehicle. Once the action is initiated, the cover starts opening automatically by the mechanism. During this process, it is possible that an object in the trunk or rear deck may fall out of the trunk or rear deck as the cover is being opened. The object may directly fall when the cover opens. Undesirably, the falling object may hurt someone's leg or foot and the object may be damaged, resulting in monetary loss.

BRIEF DESCRIPTION OF THE DRAWINGS

Non-limiting and non-exhaustive embodiments of the present disclosure are described with reference to the following figures, wherein like reference numerals refer to like parts throughout the various figures unless otherwise specified.

DETAILED DESCRIPTION

In the following description, reference is made to the accompanying drawings that form a part thereof, and in which is shown by way of illustrating specific exemplary embodiments in which the disclosure may be practiced. These embodiments are described in sufficient detail to enable those skilled in the art to practice the concepts disclosed herein, and it is to be understood that modifications to the various disclosed embodiments may be made, and other embodiments may be utilized, without departing from the scope of the present disclosure. The following detailed description is, therefore, not to be taken in a limiting sense.

Figure 1:
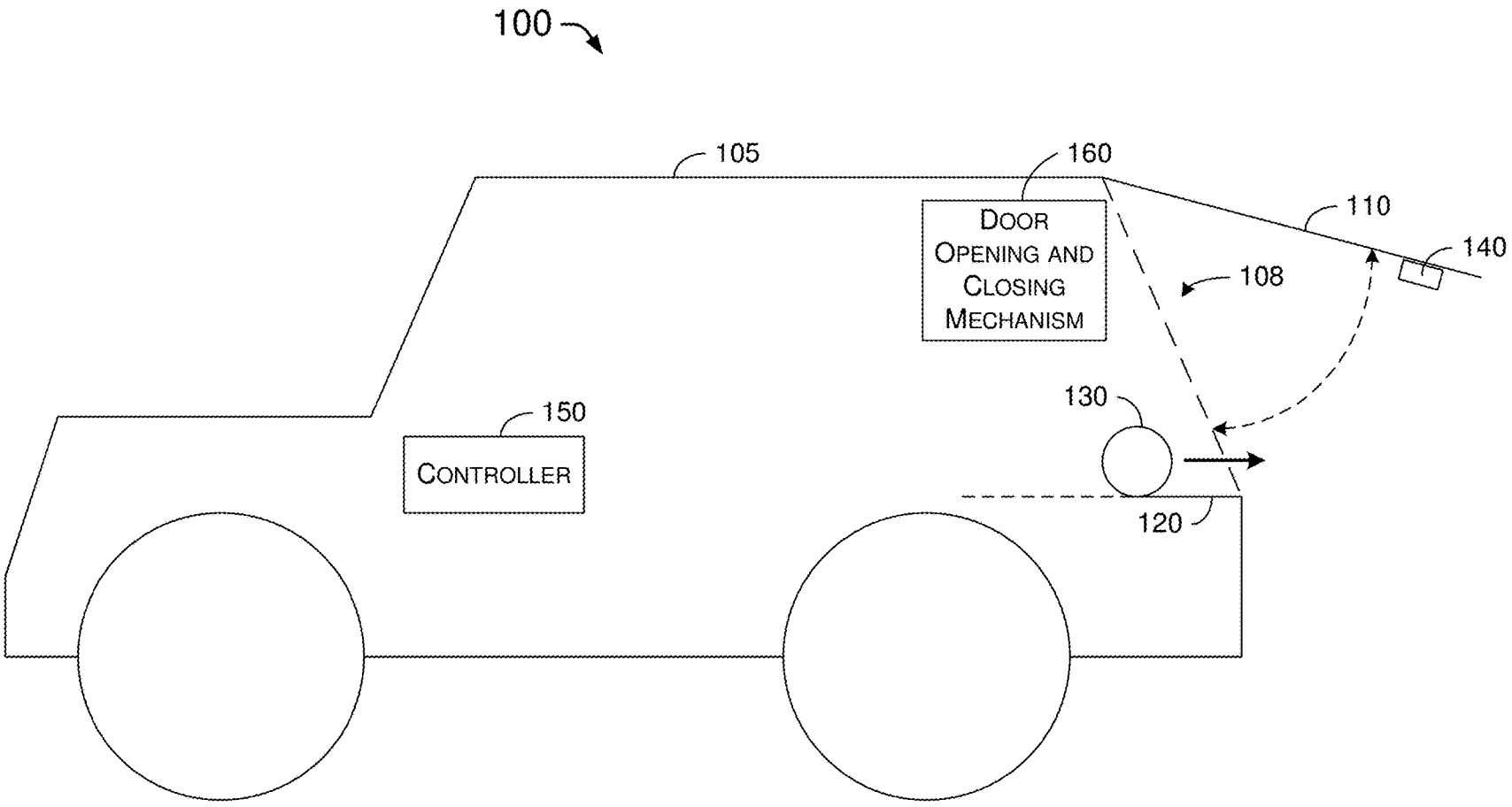
FIG. 1 is a diagram depicting an example vehicle in which example embodiments of the present disclosure may be implemented.

FIG. 1 illustrates an example vehicle 100 in which example embodiments of the present disclosure may be implemented. Referring to FIG. 1, vehicle 100 may include a car body 105 which has an opening or access point 108 with a cover 110 configured to cover the access point 108. Although in FIG. 1 vehicle 100 is depicted with the resemblance of a hatchback vehicle, vehicle 100 may be in different forms in various other implementations including, but not limited to, sedan, truck, minivan, van, bus, station wagon, crossover or any type of vehicle suitable for implementation of embodiments of the present disclosure. Accordingly, cover 110 may be a top-hinged cover (also referred to as a hatch or a trunk), a bottom-hinged cover (also referred to as a tailgate), or a side-hinged cover (also referred to as a door). In the example shown in FIG. 1, an object 130 may be rested, disposed or otherwise placed on a floor or rear deck 120 of car body 105.

Vehicle 100 may also include an intelligent vehicle access point opening system that includes at least one or more sensors 140, a controller 150 and a cover opening and closing mechanism 160. Controller 150 may be communicatively coupled to each of one or more sensors 140 and cover opening and closing mechanism 160 wirelessly and/or via one or more wires. Cover opening and closing mechanism 160 may include an electric motor, a pneumatic actuator, a hydraulic actuator, or any combination thereof. Cover opening and closing mechanism 160 may be mechanically coupled to cover 110. Controller 150 may receive a command for opening cover 110 from a user (e.g., the driver of vehicle 100) and, in response to receiving the command, activate controller 150 to open cover 110 in an intelligent manner as described below. The command for opening cover 110 may be entered by the user in a variety of ways including, for example and not limited to, wirelessly from a remote controller, by pushing a push button on the dashboard of vehicle 100, by entering the command from a touch screen on the dashboard of vehicle 100, and by a voice command provided by the user.

The aforementioned problem with falling objects may be resolved by the intelligent vehicle access point opening system of the present disclosure in any of three different approaches or a combination of two or three of these approaches, as described below. In these approaches, a falling object can be detected and preventive actions can be taken immediately such as, for example and not limited to, by pausing the opening of access point cover or closing it just enough to hold the falling object and notifying the driver.

In a first approach, the one or more sensors 140 may include one or more force sensors (also known as pressure sensors), which may be mounted, affixed or otherwise disposed on an inner side of cover 110 at suitable location(s). In some embodiments, the one or more sensors 140 are not activated for sensing or detection until the command for opening cover 110 is received by controller 150, so as to avoid unnecessary computations. When activated (e.g., after controller 150 has received a cover opening command from the user), the one or more force sensors may sense or detect a force or pressure in the event that object 130 is leaning against or resting on cover 110. Accordingly, the one or more force sensors may generate a signal indicative of the sensed force or pressure, which may be received and interpreted by controller 150 to mean that object 130 is likely to fall off as cover 110 opens. Consequently, controller 150 may send a "pause opening" signal to cover opening and closing mechanism 160 to pause the opening of cover 110. In some embodiments, controller 150 may also send a "cover closing" signal to cover opening and closing mechanism 160 to move cover 110 in a closing direction by at least a predefined distance (e.g., one or more inches) to partially or completely close cover 110. Optionally, controller 110 may also provide a notification to the user to indicate that object 130 is likely to fall, the opening of cover 110 is paused, cover 110 is being closed at least partially due to the detection of the likelihood of object 130 falling, or a combination of the above. This notification may be provided in the form of a visual signal and/or an audible signal via the dashboard, light(s), speaker and/or any other suitable component(s) of vehicle 100.

In a second approach, cover opening and closing mechanism 160 may be capable of detecting the amount of force required to open cover 110, and controller 150 may determine whether the detected amount of force is different from a predetermined amount of force used to open cover 110 under normal operating conditions. Accordingly, in an event that the detected amount of force required to open cover 110 is less than the predetermined amount of force, then it may imply that some object (e.g., object 130) is pushing or leaning against cover 110 and thus may fall off as cover 110 is opened even more. Consequently, controller 150 may send a "pause opening" signal to cover opening and closing mechanism 160 to pause the opening of cover 110. In some embodiments, controller 150 may also send a "cover closing" signal to cover opening and closing mechanism 160 to move cover 110 in a closing direction by at least a predefined distance (e.g., one or more inches) to partially or completely close cover 110. Optionally, controller 110 may also provide a notification to the user as described above.

Figure 3:
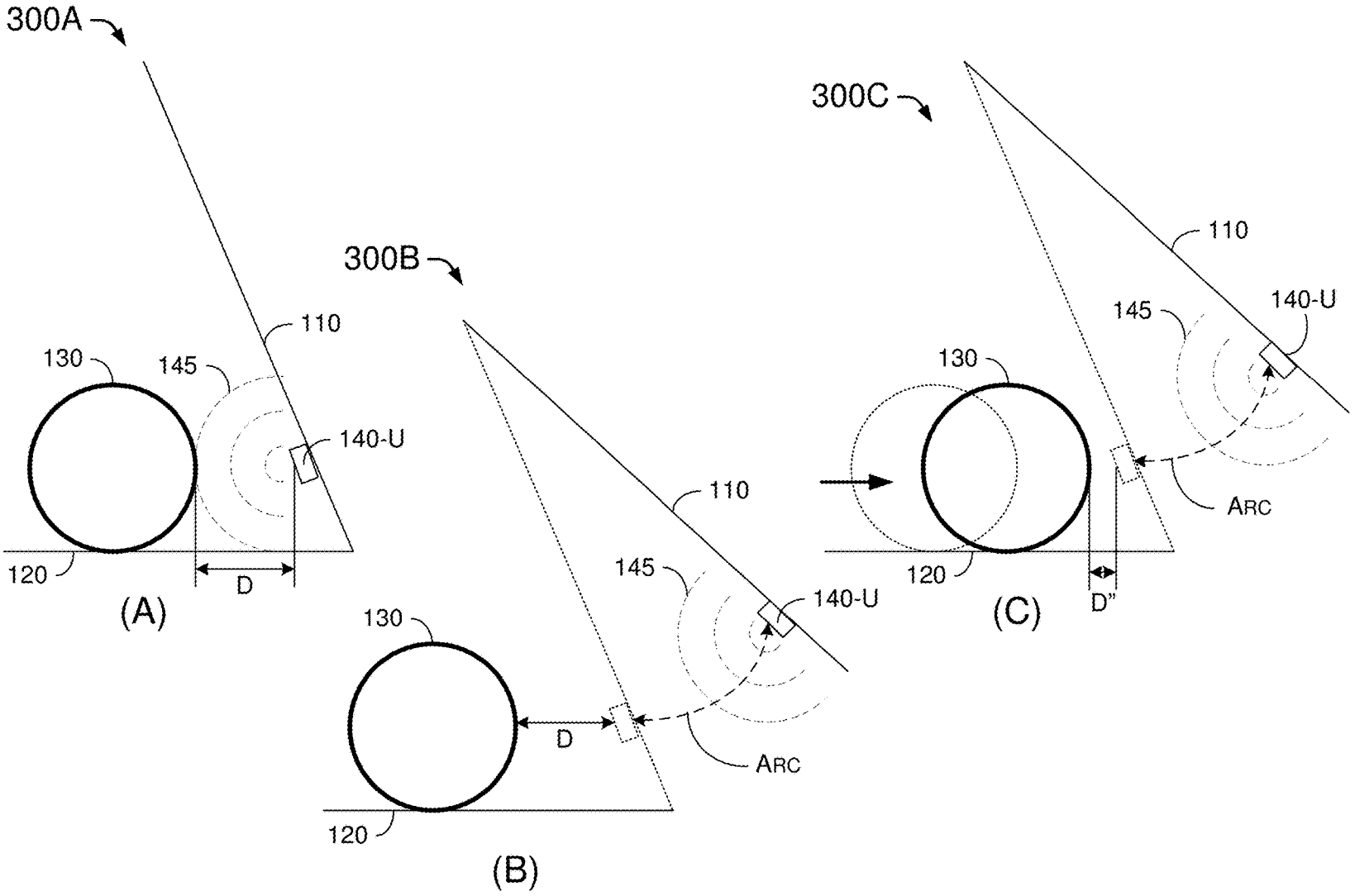
FIG. 3 is a diagram depicting example scenarios in accordance with the present disclosure.

In a third approach, the one or more sensors 140 may include one or more ultrasound sensors. The one or more ultrasound sensors may be mounted, affixed or otherwise disposed on an inner side of cover 110 as shown in FIG. 1. In some embodiments, the one or more sensors 140 are not activated for sensing or detection until the command for opening cover 110 is received by controller 150, so as to avoid unnecessary computations. In some implementations, the one or more ultrasound sensors may be positioned or otherwise oriented in such a way that each of the one or more ultrasound sensors points inwardly when cover 110 is closed. This allows the one or more ultrasound sensors to emit ultrasound waves toward the inside of car body 105 to sense any object, or person/child/pet which might be close to the sensor. The one or more ultrasound sensors may be utilized to detect the presence of an object (e.g., object 130) in the vicinity or close proximity of cover 110, and to measure a distance between the one or more sensors 140 and object 130 as cover 110 is being opened. Operations of the one or more sensors 140 in this approach is illustrated in FIG. 3 described below. In an event that it is determined that object 130 is falling as cover 110 is being opened, controller 150 may send a "pause opening" signal to cover opening and closing mechanism 160 to pause the opening of cover 110. In some embodiments, controller 150 may also send a "cover closing" signal to cover opening and closing mechanism 160 to move cover 110 in a closing direction by at least a predefined distance (e.g., one or more inches) to partially or completely close cover 110. Optionally, controller 110 may also provide a notification to the user as described above.

In a fourth approach, which may be a combination of the first approach and the second approach described above, the one or more sensors 140 may include one or more force sensors (or pressure sensors), and cover opening and closing mechanism 160 may be capable of detecting the amount of force required to open cover 110. Accordingly, controller 150 may determine whether object 130 is falling as cover 110 is being opened by determining whether the detected amount of force is different from a predetermined amount of force used to open cover 110 under normal operating conditions and determining whether or not one or more sensors 140, as force sensors, is activated.

In a fifth approach, which may be a combination of the first approach and the third approach described above, the one or more sensors 140 may include one or more force sensors (or pressure sensors) as well as one or more ultrasound sensors. Accordingly, controller 150 may determine whether object 130 is falling as cover 110 is being opened by determining whether the one or more force sensors is activated and based on the distance between one or more ultrasound sensors and object 130 as measured by the one or more ultrasound sensors.

In a sixth approach, which may be a combination of the first approach, the second approach and the third approach described above, the one or more sensors 140 may include one or more force sensors (or pressure sensors) as well as one or more ultrasound sensors. Accordingly, controller 150 may determine whether object 130 is falling as cover 110 is being opened by determining whether the detected amount of force is different from a predetermined amount of force used to open cover 110 under normal operating conditions and determining whether or not one or more force sensors is activated, and based on the distance between one or more ultrasound sensors and object 130 as measured by the one or more ultrasound sensors.

In some embodiments, as an alternative or in addition, the one or more sensors 140 may include one or more of a camera, a radio detection and ranging (RADAR) sensor, a light detection and ranging (LIDAR) sensor, or a combination thereof.

Figure 2:
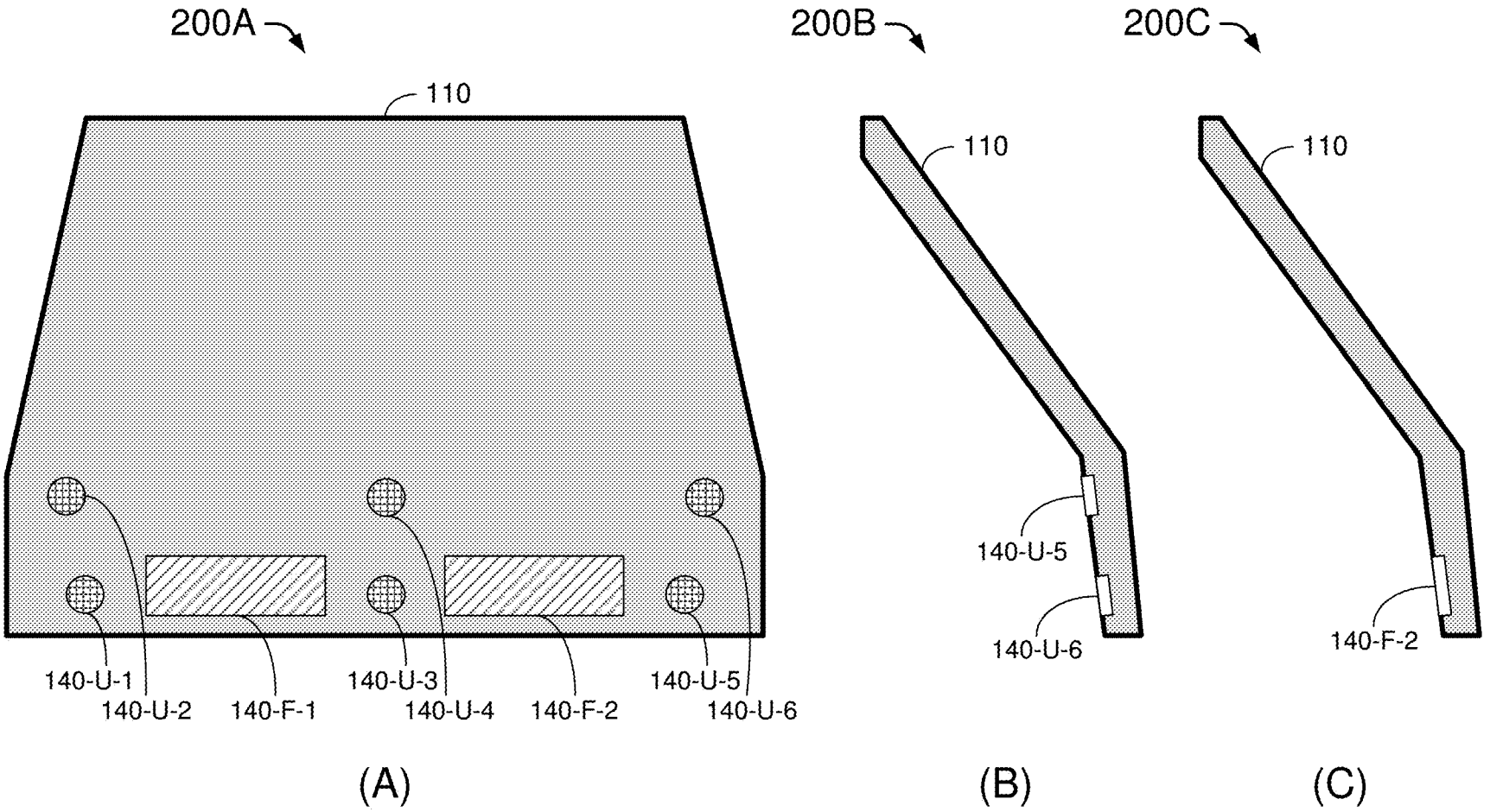
FIG. 2 is a diagram depicting example scenarios showing example positioning of one or more sensors in accordance with the present disclosure.

FIG. 2 illustrates example scenarios 200A, 200B and 200C showing example positioning of one or more sensors in accordance with the present disclosure. Scenario 200A in part (A) of FIG. 2 shows example positioning of one or more sensors 140 on an inner surface of cover 110. In scenario 200A, one or more ultrasound sensors, such as 140-U-1, 140-U-2, 140-U-3, 140-U-4, 140-U-5 and 140-U-6, may be disposed at various locations on the inner surface of cover 110. Each of the one or more ultrasound sensors may be oriented in such a way that it points inwards when cover 110 is closed to allow the ultrasound sensor to sense any object, person, child or pet which might be close to the ultrasound sensor. Alternatively or additionally, in scenario 200A one or more force sensors, such as 140-F-1 and 140-F-2, may be disposed at various locations on the inner surface of cover 110. Each of the one or more force sensors may be positioned in such a way that activation of a force sensor implies that an object is resting on or leaning against cover 110 and that such object is likely to fall out as cover 110 is opened. Scenario 200B in part (B) of FIG. 2 shows a side view of cover 110 with one or more ultrasound sensors disposed on the inner surface of cover 110. Scenario 200C in part (C) of FIG. 2 shows a side view of cover 110 with one or more force sensors disposed on the inner surface of cover 110. Although a set number of ultrasound sensors and a set number of force sensors are shown in FIG. 2, in various implementations in accordance with the present disclosure the actual number of ultrasound sensors and the actual number of force sensors may differ, ranging between 0 and N, with N being a positive integer equal to or greater than 1.

FIG. 3 illustrates example scenarios 300A, 300B and 300C to depict the principle of operation of the one or more sensors 140 as one or more ultrasound sensors. Referring to scenario 300A in part (A) of FIG. 3, as controller 150 receives a command from the user for opening cover 110, controller 150 may activate the one or more sensors 140, which include one or more ultrasound sensors, to detect the presence of any object in the vicinity of cover 110. The one or more sensors 140 may emit ultrasound waves 145 and detect that object 130 is at a distance D away from cover 110 or, more accurately, from the one or more sensors 140. In scenario 300B, shown in part (B) of FIG. 3, object 130 is stationary and not falling off as cover 110 is being opened, and thus the original distance D remains unchanged. Accordingly, as cover 110 is being opened with the one or more sensors 140 emitting ultrasound waves 145, the distance measurement between the one or more sensors 140 and object 130 should be increasing in a mathematically-defined way. In scenario 300C, shown in part (C) of FIG. 3, object 130 is non-stationary and is falling off as cover 110 is being opened, and thus the original distance D is decreased to a smaller distance D". Accordingly, as cover 110 is being opened with the one or more sensors 140 emitting ultrasound waves 145, the distance measurement between the one or more sensors 140 and object 130 is not increasing in the mathematically-defined way, given the movement of object 130.

Figure 4:
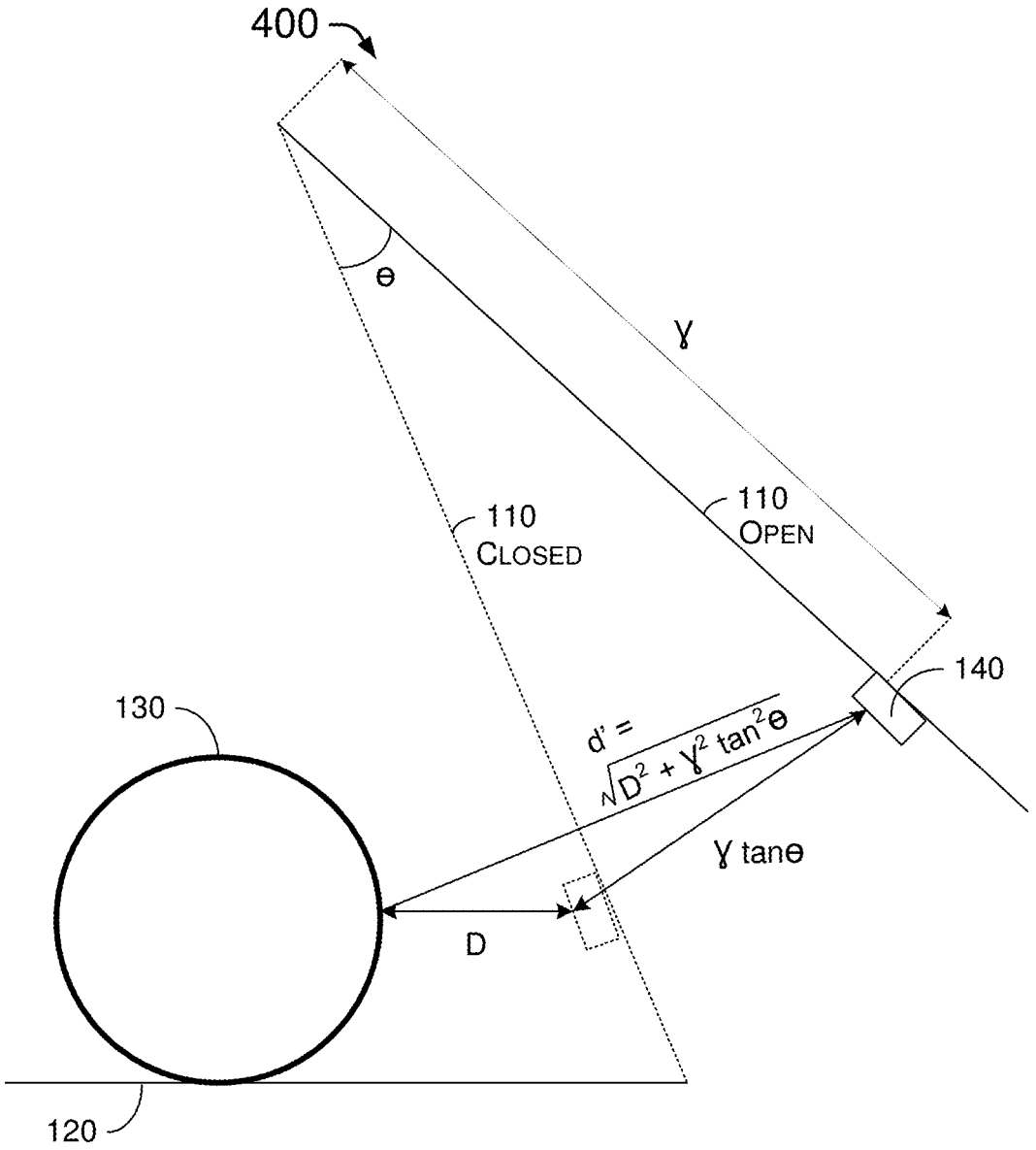
FIG. 4 is a diagram depicting an example measurement of a distance between a sensor and an object in accordance with the present disclosure.

FIG. 4 illustrates an example measurement of a distance between a sensor 140 and object 130 in accordance with the present disclosure. Referring to FIG. 4, when cover 110 is at a closed position the distance between object 130 and sensor 140 is D. As cover 110 is moved to an open position, which is $\Theta$ degrees from the closed position, the distance d' between sensor 140 and object 130 would be expressed as follows provided that object 130 remains stationary: $d'=(D^2+\gamma^2 \tan^2 \Theta)^{1/2}$. Here, parameter $\gamma$ denotes a distance between sensor 140 and a hinge or pivoting point of cover 110. Thus, an assumption may be made that object 130 is falling or likely to fall under the following condition: $d'<(D^2+\gamma^2 \tan^2 \Theta)^{1/2}$. Conversely, an assumption may be made that object 130 is not falling or not likely to fall under the following condition: $d'\geq(D^2+\gamma^2 \tan^2 \Theta)^{1/2}$.

Figure 5:
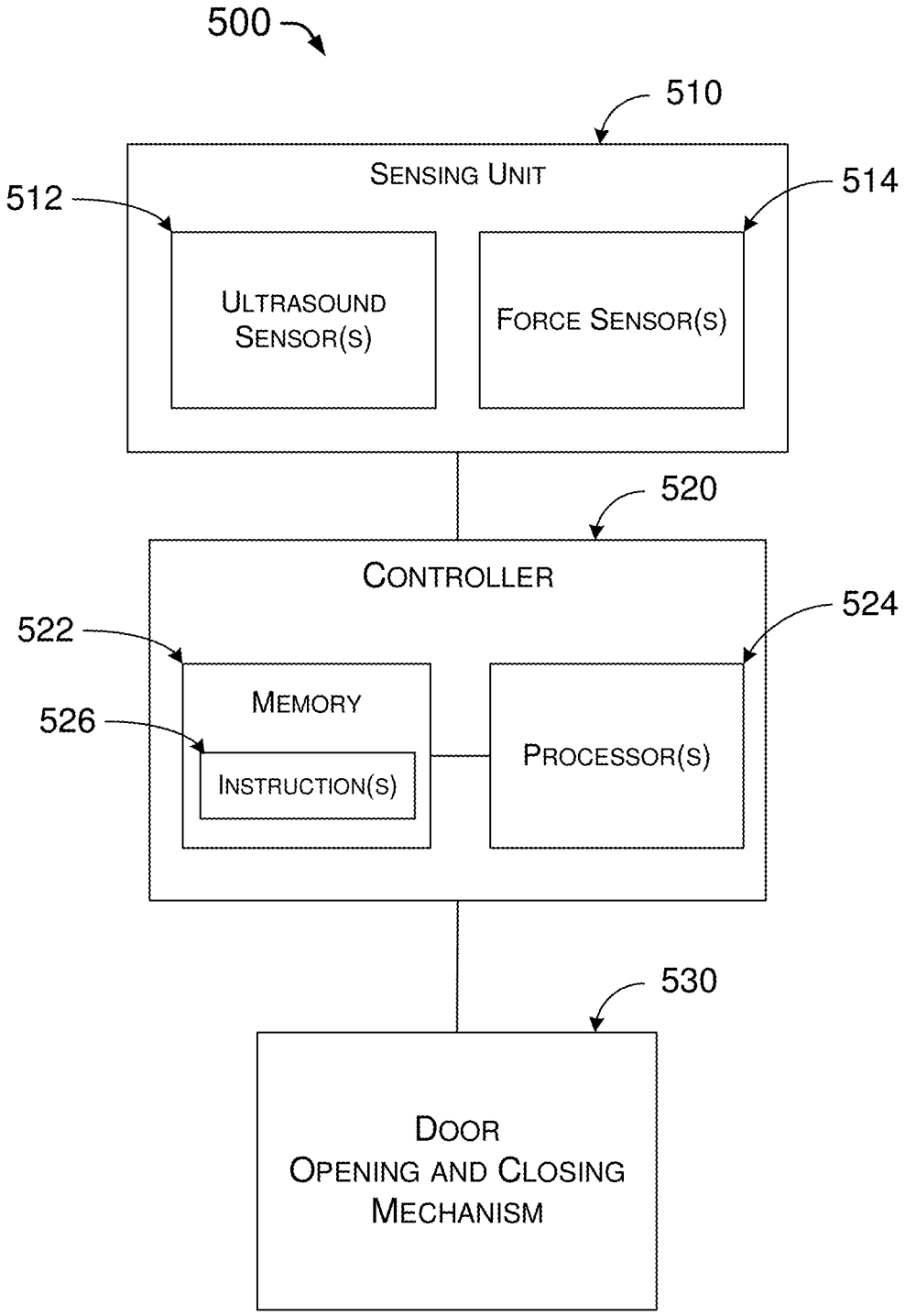
FIG. 5 is a block diagram depicting an example apparatus in accordance with an embodiment of the present disclosure.

FIG. 5 illustrates an example apparatus 500 in accordance with an embodiment of the present disclosure. Apparatus 500 may be an example implementation of the intelligent vehicle access point opening system of vehicle 100. Referring to FIG. 5, apparatus 500 may include a sensing unit 510, a controller 520 and a cover opening and closing mechanism 530.

Sensing unit 510 may include one or more sensors of one or more types. For example, sensing unit 510 may include one or more ultrasound sensors 512. Alternatively or additionally, sensing unit 510 may include one or more force or pressure sensors 514. The one or more sensors of sensing unit 510 (e.g., one or more ultrasound sensors 512 and/or one or more force sensors 514) may be configured to detect a presence of an object in a vicinity of a cover of an access point of a vehicle (e.g., cover 110 of vehicle 100), and output data related to the detecting.

Cover opening and closing mechanism 530 may be mechanically coupled to the cover of the vehicle and configured to open and close the cover. Cover opening and closing mechanism 530 may include an electric motor, a pneumatic actuator, a hydraulic actuator, or any combination thereof.

Controller 520 may be communicatively coupled to the one or more sensors (e.g., one or more ultrasound sensors 512 and/or one or more force sensors 514) of sensing unit 510 as well as cover opening and closing mechanism 530 wirelessly and/or via one or more wires. Controller 520 may include a memory 522 and one or more processors 524. Memory 522 may be configured to store one or more sets of instructions 526 executable by the one or more processors 524. Upon executing the one or more sets of instructions 526, the one or more processors 524 may be configured to perform one or more of the operations of controller 520 described herein.

Controller 520 may be configured to receive a command to open the cover of the vehicle and, in response to receiving the command, activate cover opening and closing mechanism 530 to open the cover. Controller 520 may, based on data provided by the one or more sensors of sensing unit 510, determine whether the object is likely to fall as the cover is being opened. In an event that controller 520 determines that the object is likely to fall as the cover is being opened, controller 520 may send a signal to cover opening and closing mechanism 530 to pause the opening of the cover. Optionally, controller 520 may be also configured to send another signal to cover opening and closing mechanism 530 to move the cover in a closing direction by at least a predefined distance to partially or completely close the cover. Optionally, controller 520 may be further configured to provide a notification to a user of the vehicle regarding the detection that the object is likely to fall as the cover is being opened. In an event that no object is detected or that an object is detected but determined not likely to fall as the cover is being opened, controller 520 may allow cover opening and closing mechanism 530 to complete the cover opening operation to completely open the cover.

In some embodiments, in determining whether the object is likely to fall as the cover is being opened, controller 520 may be configured to determine whether a distance between the one or more ultrasound sensors 512 and the object is increasing in a mathematically-defined way as the cover is being opened. Moreover, in pausing the opening of the cover responsive to a determination that the object is likely to fall as the cover is being opened, controller 520 may be configured to pause the opening of the cover responsive to a determination that the distance between the one or more ultrasound sensors 512 and the object is not increasing in the mathematically-defined way as the cover is being opened.

In some embodiments, in determining whether the object is likely to fall as the cover is being opened, controller 520 may be configured to determine a distance between the one or more ultrasound sensors 512 and the object as the cover is being opened. Additionally, in pausing the opening of the cover responsive to a determination that the object is likely to fall as the cover is being opened, controller 520 may be configured to pause the opening of the cover responsive to the determined distance being less than a predetermined threshold distance.

In some embodiments, in determining whether the object is likely to fall as the cover is being opened, controller 520 may be configured to determine that the object is likely to fall responsive to the one or more force sensors 514 and at least a sensor of a different type (e.g., ultrasound sensor) detecting the presence of the object as the cover is being opened.

In some embodiments, in detecting the presence of the object, controller 520 may be configured to detect, based on data received from cover opening and closing mechanism 530, an amount of force used by cover opening and closing mechanism 530 to open the cover. Controller 520 may also be configured to determine whether the detected amount of force is different from a predetermined amount of force. For instance, controller 520 may be configured to detect the presence of the object in an event that the detected amount of force is less than the predetermined amount of force.

Figure 6:
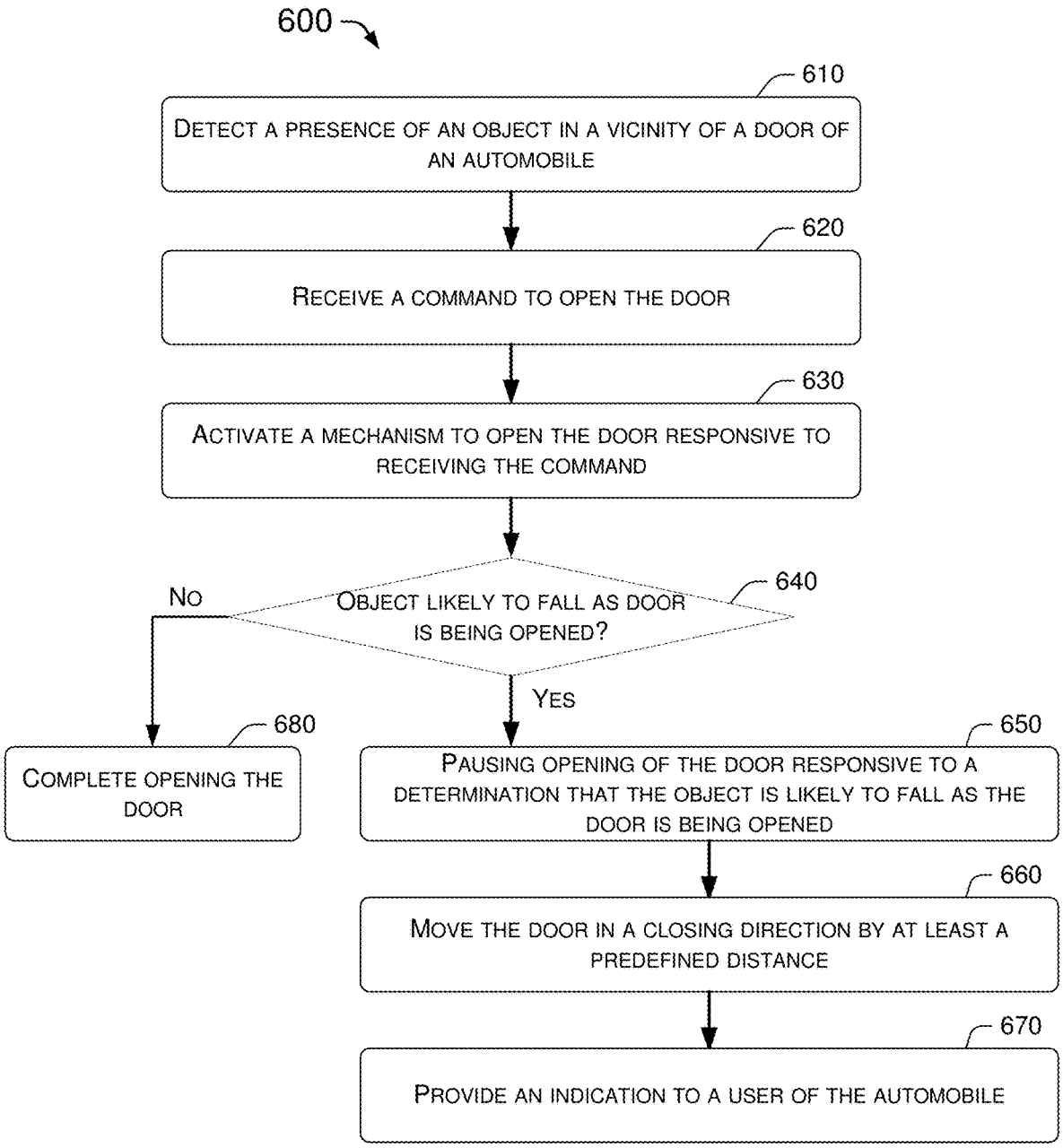
FIG. 6 is a flowchart of an example process in accordance with an embodiment of the present disclosure.

FIG. 6 illustrates an example process 600 in accordance with an embodiment of the present disclosure. Process 600 may include one or more operations, actions, or functions shown as blocks such as 610, 620, 630, 640, 650, 660, 670 and 680. Although illustrated as discrete blocks, various blocks may be divided into additional blocks, combined into fewer blocks, or eliminated, depending on the desired implementation. Process 600 may be implemented in or by vehicle 100, example scenarios 300A, 300B and 300C and/or apparatus 500. For simplicity of description and not limiting the scope thereof, process 600 is described below in the context of vehicle 100. Process 600 may begin with block 610.

At 610, process 600 may involve one or more sensors 140 detecting a presence of an object 130 in a vicinity of a cover 110 of a vehicle 100. Block 610 may be followed by block 620.

At 620, process 600 may involve controller 150 receiving a command to open cover 110. Block 620 may be followed by block 630.

At 630, process 600 may involve controller 150 activating a mechanism 160 to open cover 110 responsive to receiving the command. Block 630 may be followed by block 640.

At 640, process 600 may involve controller 150 determining whether object 130 is likely to fall as cover 110 is being opened. In an event that it is determined by controller 150 that object 130 is not likely to fall as cover 110 is being opened by mechanism 160, process 600 may proceed to 680. Alternatively, in an event that it is determined by controller 150 that object 130 is likely to fall as cover 110 is being opened by mechanism 160, process 600 may proceed to 650.

At 650, process 600 may involve controller 150 pausing opening of cover 110 by mechanism 160 in response to a determination by controller 150 that object 130 is likely to fall as cover 110 is being opened by mechanism 160. Block 650 may be followed by block 660.

At 660, process 600 may involve controller 150 controlling mechanism 160 to move cover 110 in a closing direction by at least a predefined distance. Block 660 may be followed by block 670.

At 670, process 600 may involve controller 150 providing a notification to a user of vehicle 100, for example, to inform the user that cover 110 is not being opened due to an object, e.g., object 130, is detected as likely to fall as cover 110 is being opened.

At 680, process 600 may involve mechanism 160 completing the opening of cover 110.

In some embodiments, one or more sensors 140 may include one or more ultrasound sensors. In some embodiments, in determining whether object 130 is likely to fall as cover 110 is being opened by mechanism 160, process 600 may involve controller 150 determining whether a distance between the one or more ultrasound sensors and object 130 is increasing in a mathematically-defined way as cover 110 is being opened. In such cases, in pausing the opening of cover 110 responsive to a determination that object 130 is likely to fall as cover 110 is being opened, process 600 may involve controller 150 pausing the opening of cover 110 responsive to a determination that the distance between the one or more ultrasound sensors and object 130 is not increasing in the mathematically-defined way as cover 110 is being opened. Alternatively or additionally, in determining whether object 130 is likely to fall as cover 110 is being opened, process 600 may involve controller 150 determining a distance between the one or more ultrasound sensors and object 130 as cover 110 is being opened. In such cases, in pausing the opening of cover 110 responsive to a determination that object 130 is likely to fall as cover 110 is being opened, process 600 may involve controller 150 pausing the opening of cover 110 responsive to the determined distance being less than a predetermined threshold distance.

In some embodiments, one or more sensors 140 may include one or more force sensors and at least a sensor of a different type (e.g., ultrasound sensor). In some embodiments, in determining whether object 130 is likely to fall as cover 110 is being opened, process 600 may involve controller 150 determining that object 110 is likely to fall responsive to the one or more force sensors and the sensor(s) of the different type detecting the presence of object 130 as cover 110 is being opened.

In some embodiments, in detecting the presence of object 130, process 600 may involve controller 150 measuring an amount of force used by mechanism 160 to open cover 110. Additionally, process 600 may involve controller 150 determining whether the measured amount of force is different from a predetermined amount of force. In some embodiments, process 600 may also involve controller 150 detecting the presence of object 130 in an event that the measured amount of force is less than the predetermined amount of force. For instance, if the measured amount of force is less than the predetermined amount of force, controller 150 may determine that object 130 is leaning on or against cover 110 and thereby exerting at least a part of the weight of object 130 on cover 110, thus making it relatively easier to open cover 110 (i.e., requiring mechanism 160 to exert less force to open cover 110).

In some embodiments, in activating mechanism 160 to open cover 110, process 600 may involve controller 150 activating an electric motor, a pneumatic actuator, a hydraulic actuator, or a combination thereof of mechanism 160 to open cover 110.

The articles "a" and "an" are used herein to refer to one or to more than one (i.e., to at least one) of the grammatical object of the article. By way of example, "a user" means one user or more than one users. Reference throughout this specification to "one embodiment," "an embodiment," "one example," or "an example" means that a particular feature, structure, or characteristic described in connection with the embodiment or example is included in at least one embodiment of the present disclosure. Thus, appearances of the phrases "in one embodiment," "in an embodiment," "one example," or "an example" in various places throughout this specification are not necessarily all referring to the same embodiment or example. Furthermore, the particular features, structures, databases, or characteristics may be combined in any suitable combinations and/or sub-combinations in one or more embodiments or examples. In addition, it should be appreciated that the figures provided herewith are for explanation purposes to persons ordinarily skilled in the art and that the drawings are not necessarily drawn to scale.

Embodiments in accordance with the present disclosure may be embodied as an apparatus, method, or computer program product. Accordingly, the present disclosure may take the form of an entirely hardware-comprised embodiment, an entirely software-comprised embodiment (including firmware, resident software, micro-code or the like), or an embodiment combining software and hardware aspects that may all generally be referred to herein as a "circuit," "module," or "system." Furthermore, embodiments of the present disclosure may take the form of a computer program product embodied in any tangible medium of expression having computer-usable program code embodied in the medium.

The flow diagrams and block diagrams in the attached figures illustrate the architecture, functionality, and operation of possible implementations of systems, methods, and computer program products according to various embodiments of the present disclosure. In this regard, each block in the flow diagrams or block diagrams may represent a module, segment, or portion of code, which comprises one or more executable instructions for implementing the specified logical function(s). It will also be noted that each block of the block diagrams and/or flow diagrams, and combinations of blocks in the block diagrams and/or flow diagrams, may be implemented by special purpose hardware-based systems that perform the specified functions or acts, or combinations of special purpose hardware and computer instructions. These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flow diagram and/or block diagram block or blocks.

Although the present disclosure is described in terms of certain embodiments, other embodiments will be apparent to those of ordinary skill in the art, given the benefit of this disclosure, including embodiments that do not provide all of the benefits and features set forth herein, which are also within the scope of this disclosure. It is to be understood that other embodiments may be utilized, without departing from the scope of the present disclosure.

The invention claimed is:

1. An apparatus implementable in a vehicle, comprising:
one or more sensors configured to detect a presence of an object in a vicinity of a cover of an access point of the vehicle and inside the vehicle, the one or more sensors also configured to output data related to the detecting;
a mechanism configured to open and close the cover; and
a controller communicatively coupled to the one or more sensors and the mechanism, the controller configured to perform operations comprising:
receiving a command to open the cover;
activating the mechanism to open the cover responsive to receiving the command;
determining whether the object is likely to fall from inside the vehicle to outside the vehicle after the cover has been at least partially opened by:
measuring a relative distance between the object and a sensor on the cover as the cover is being opened; and
determining, based on the relative distance, whether the object is stationary and whether the object is non-stationary and moving toward the cover as the cover is being opened; and
pausing opening of the cover based on determining that the object is likely to fall based on determining that the object is non-stationary and moving toward the cover as the cover was being opened.

2. The apparatus of claim 1, wherein the one or more sensors comprise one or more ultrasound sensors.

3. The apparatus of claim 2, in determining whether the object is likely to fall from inside the vehicle to outside the vehicle as the cover is being opened, the controller is configured to determine whether a distance between the one or more ultrasound sensors and the object is increasing in a mathematically-defined way as the cover is being opened, and wherein, in pausing the opening of the cover responsive to a determination that the object is likely to fall as the cover is being opened, the controller is configured to pause the opening of the cover responsive to a determination that the distance between the one or more ultrasound sensors and the object is not increasing in the mathematically-defined way as the cover is being opened.

4. The apparatus of claim 2, wherein, in determining whether the object is likely to fall from inside the vehicle to outside the vehicle as the cover is being opened, the controller is configured to determine a distance between the one or more ultrasound sensors and the object as the cover is being opened, and wherein, in pausing the opening of the cover responsive to a determination that the object is likely to fall as the cover is being opened, the controller is configured to pause the opening of the cover responsive to the determined distance being less than a predetermined threshold distance.

5. The apparatus of claim 1, wherein the one or more sensors comprise one or more force sensors and at least one sensor of a different type.

6. The apparatus of claim 5, wherein, in determining whether the object is likely to fall from inside the vehicle to outside the vehicle as the cover is being opened, the controller is configured to determine that the object is likely to fall responsive to the one or more force sensors and the at least one sensor of the different type detecting the presence of the object as the cover is being opened.

7. The apparatus of claim 1, wherein, in detecting the presence of the object, the controller is configured to perform operations comprising:
detecting an amount of force used by the mechanism to open the cover; and
determining whether the detected amount of force is different from a predetermined amount of force.

8. The apparatus of claim 7, wherein the controller is further configured to perform operations comprising:
detecting the presence of the object in an event that the detected amount of force is less than the predetermined amount of force.

9. The apparatus of claim 1, wherein the mechanism comprises an electric motor, a pneumatic actuator, a hydraulic actuator, or a combination thereof.

10. The apparatus of claim 1, wherein the controller is further configured to perform operations comprising:
moving the cover in a closing direction by at least a predefined distance; and
providing a notification to a user of the vehicle.

11. A method, comprising:
activating a mechanism to open a cover of an access point of a vehicle;
determining whether an object inside the vehicle is likely to fall from inside the vehicle to outside the vehicle after the cover has been at least partially opened by:
measuring a relative distance between the object and a sensor on the cover as the cover is being opened; and
determining, based on the relative distance, whether the object is stationary and whether the object is non-stationary and moving toward the cover as the cover is being opened; and pausing opening of the cover based on determining that the object is likely to fall responsive to a determination that the object is non-stationary and moving toward the cover as the cover was being opened.

12. The method of claim 11, wherein the activating of the mechanism to open the cover comprises activating an electric motor, a pneumatic actuator, a hydraulic actuator, or a combination thereof to open the cover.

13. The method of claim 11, further comprising:

detecting a presence of the object in the vicinity of the cover and inside the vehicle;

receiving a command to open the cover;

moving the cover in a closing direction by at least a predefined distance; and providing a notification to a user of the vehicle.

14. The method of claim 13, wherein the sensor comprises one or more ultrasound sensors, and wherein the detecting of the presence of the object comprises detecting the presence of the object using the one or more ultrasound sensors.

15. The method of claim 14, wherein the determining of whether the object is likely to fall from inside the vehicle to outside the vehicle after the cover has been at least partially opened comprises determining whether a distance between the one or more ultrasound sensors and the object is increasing in a mathematically-defined way as the cover is being opened, and wherein the pausing of the opening of the cover responsive to a determination that the object is likely to fall as the cover is being opened comprises pausing the opening of the cover responsive to a determination that the distance between the one or more ultrasound sensors and the object is not increasing in the mathematically-defined way as the cover is being opened.

16. The method of claim 14, wherein the determining of whether the object is likely to fall from inside the vehicle to outside the vehicle after the cover has been at least partially opened comprises determining a distance between the one or more ultrasound sensors and the object as the cover is being opened, and wherein the pausing of the opening of the cover responsive to a determination that the object is likely to fall as the cover is being opened comprises pausing the opening of the cover responsive to the determined distance being less than a predetermined threshold distance.

17. The method of claim 13, wherein the sensor comprises one or more force sensors, and wherein the detecting of the presence of the object comprises detecting the presence of the object using the one or more force sensors and at least one sensor of a different type.

18. The method of claim 17, wherein the determining of whether the object is likely to fall from inside the vehicle to outside the vehicle after the cover has been at least partially opened comprises determining that the object is likely to fall responsive to the one or more force sensors and the least one sensor of the different type detecting the presence of the object as the cover is being opened.

19. The method of claim 13, wherein the detecting of the presence of the object comprises:

detecting an amount of force used by the mechanism to open the cover; and determining whether the detected amount of force is different from a predetermined amount of force.

20. The method of claim 19, further comprising:

detecting the presence of the object in an event that the detected amount of force is less than the predetermined amount of force.

* * * * *